US005165641A

United States Patent [19]

Southern

[11] Patent Number: 5,165,641

[45] Date of Patent: Nov. 24, 1992

[54] LARGE CONTACT AREA BRACES FOR A LADDER

[76] Inventor: Don L. Southern, 1918 Euharlee Rd., Kingston, Ga. 30145-2502

[21] Appl. No.: 510,066

[22] Filed: Apr. 17, 1990

[51] Int. Cl.[5] ..... E04G 3/00

[52] U.S. Cl. ..... 248/230; 182/214

[58] Field of Search ..... 248/210, 230; 182/108, 182/208, 214

[56] References Cited

U.S. PATENT DOCUMENTS

| | | | |
|---|---|---|---|
| 2,200,902 | 5/1940 | Solomon | 182/108 |
| 2,371,460 | 3/1945 | Needham | 182/108 |
| 2,465,143 | 3/1949 | Wood | 248/210 |
| 2,886,277 | 5/1959 | Boham et al. | 248/210 |
| 3,715,012 | 2/1973 | Perry | 182/214 X |
| 3,987,993 | 10/1976 | Hopkins | 248/210 |
| 3,998,416 | 12/1976 | Benolkin | 248/210 |
| 4,369,860 | 1/1983 | Beane | 248/210 X |
| 4,823,912 | 4/1989 | Gould et al. | 248/210 X |

FOREIGN PATENT DOCUMENTS

| | | | |
|---|---|---|---|
| 1248760 | 11/1960 | France | 182/108 |

*Primary Examiner*—Gary L. Smith
*Assistant Examiner*—Michael Milano
*Attorney, Agent, or Firm*—John L. James

[57] ABSTRACT

Large contact areas braces for attachment to the siderails of a ladder maintain the top end of the ladder away from the work surface against which the siderails would ordinarily rest. Each brace provides a large surface area to contact the work surface to prevent defacing of the work surface by the side rails of the ladder. The large contact areas of the braces grip the work surface to prevent the ladder from slipping or sliding. The braces have contact pads that pivot horizontally so that the ladder can straddle corners.

4 Claims, 1 Drawing Sheet

LARGE CONTACT AREA BRACES FOR A LADDER

TECHNICAL FIELD

This invention generally relates to ladders, and, more particularly to ladder attachments for positioning the ladder away from the work surface, preventing the ladder from defacing the work surface, and preventing the ladder from slipping or sliding.

BACKGROUND OF THE INVENTION

A ladder is used to help people reach places they would not ordinarily be able to reach. Ladders are often used to climb onto roofs of buildings and are used when washing window or painting. In normal use, the bottom portion of the ladder rests on the ground or other surface, and the top end of the ladder typically leans against the building or work surface. The ladder is oriented at an angle which makes it easy for a user to climb up and down the ladder, and also aids in keeping the ladder from slipping.

One problem with ladders, especially when painting or cleaning the exterior of a house, is that there is an amount of instability because the ladder rests on the side of the house with the only contact with the house being a small portion of the siderails of the ladder. When a person on the ladder reaches outside the rails, the center of gravity shifts causing one or both rails may slide along the work surface, thereby damaging the work surface. Accordingly, it will be appreciated that it would be highly desirable to have a ladder that has lateral stability under normal working conditions and resists sliding.

Another problem with typical ladders is that the siderails of the ladder rest on the work surface with a very small contact area which sometimes dents, scrapes, bruises or otherwise defaces the work surface. It is desirable to have a ladder that contacts the work surface with a broad surface area that does not deface the work surface.

With typical ladders, a work surface with a corner presents a problem. The ladder has to be positioned on one of the two surfaces forming the corner to stabilize the ladder, but this makes the other surface difficult to reach. A typical ladder cannot straddle the corners because the rungs would rest against the corner with the siderails void of contact with the two surfaces creating an unstable condition. Accordingly, it will be appreciated that it would be highly desirable to have a ladder that can straddle a corner without losing stability.

SUMMARY OF THE INVENTION

The present invention is directed to overcoming one or more of the problems set forth above. Briefly summarized, according to one aspect of the present invention, a brace for a ladder having first and second siderails connected by a rung comprises an extension arm having a flange on one end portion and an opening in the distal end portion. The flange has first and second openings. A U-bolt has its legs inserted through the first and second openings of the flange. The legs have threaded ends and are spaced to receive said ladder rung therebetween. First and second nuts are threadably mateable with the legs of the U-bolt to secure the flange to the U-bolt. A resilient pad assembly is pivotally connected to the extension arm.

It is an object of the present invention to provide a non-slip gripping portion for a ladder that grips the work surface without damaging the work surface.

Another object of the invention is to provide ladder which effectively increases the contact area of the ladder with the work surface.

Another object of the invention is to provide an attachment for a ladder to improve the lateral stability of the ladder.

Still another object of the present invention is to provide a ladder that can straddle a corner without losing stability.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
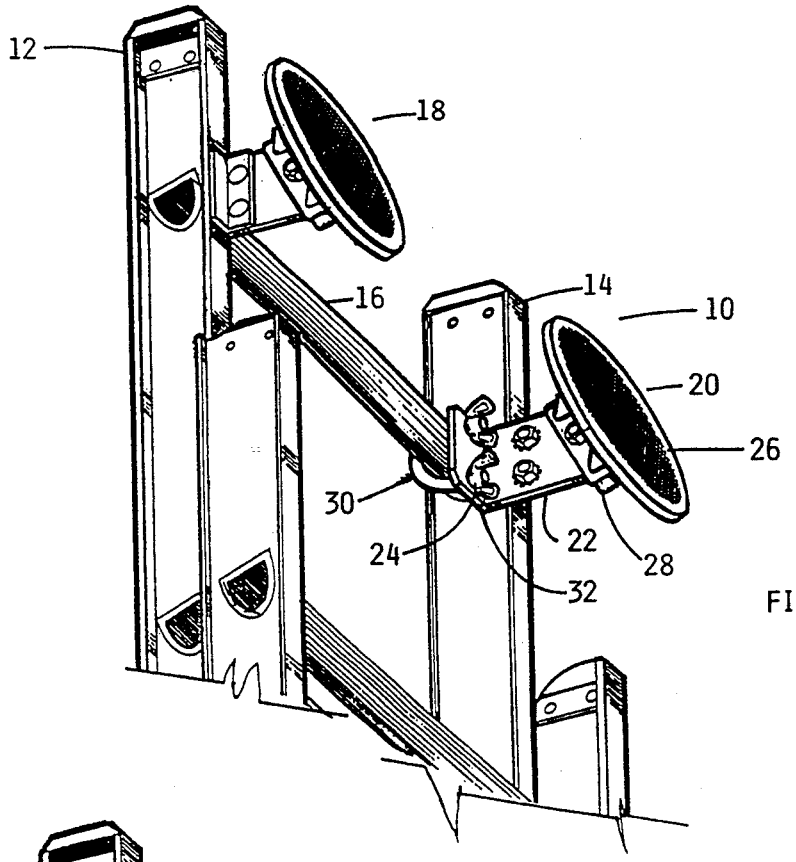
FIG. 1 is an isometric view of a preferred embodiment of a ladder with large contact area braces attached in accordance with the present invention.

Referring to FIG. 1, a ladder 10 has first and second siderails 12, 14, and a plurality of rungs 16 extending at spaced intervals between the siderails 12, 14. In the ladder 10, the length of the rungs 16 is fixed and thereby fixes the width of the ladder 10. The width of the ladder 10 typically ranges from about ten to about twenty inches, while the length ranges from about ten to about forty feet or more. Thus, the ladder 10 is very long compared to its width.

A first large contact area brace assembly 18 is attached to the first siderail 12 of the ladder 10, and a second large contact area brace assembly 20 is attached to the second siderail 14 of the ladder 10. The brace assemblies 18, 20 are interchangeable, and the left brace 18 may be used on the right siderail 14 while the right brace 20 is used on the left siderail 12. Only the right brace assembly 20 will be described in detail herein with it being understood that the left brace assembly 18 is identical.

The right brace assembly 20 includes an arm 22 with a flange 24 formed on one end opposite its distal end. On the distal end, the arm 22 has a bore for vertically pivotally connecting a resilient pad assembly 26, preferably by means of a bolt 28. Such a resilient pad assembly is described in detail in U.S. Pat. No. 4,754,842, which issued to the present inventor on Jul. 5, 1988, and which is incorporated herein by reference.

The flange 24 has two openings through which the two ends a U-bolt 30 extend. The two ends of the U-bolt 30 are secured with nuts, and washers as desired. The U-bolt 30 encircles the rung 16 which is preferably the top rung of the ladder 10, but may be positioned about any rung on the fly rail of the ladder 10 without hindering the extension and retraction of the ladder 10. The arm 22 and flange 24 are preferably formed of a single piece of steel or other strong, durable material. When a rigid piece of steel is used for the flange 24, the U-bolt 30 may simply be secured with nuts with enough torque to maintain the arm 22 in position. Lock washers are not necessary because the nuts on the U-bolt 30 can be tightened sufficiently as desired. When the flange 24 is made of softer material, washers may be used so that the flange 24 does not deface or deteriorate.

A clamp 32 is formed from an L-shaped piece of material. The arm 22 has an opening that is alignable with an opening in the clamp 32. The clamp 32 is positioned in abutting contact with the siderail 14 and arm 22 and secured in position with a bolt through the openings in the arm 22 and clamp 32. The opening in the arm 22 may be an elongated opening or slot so that the clamp 32 can be moved or adjusted to accommodate different sizes of ladders 10. The left brace assembly 18 is constructed in the same manner as the right brace assembly 20 with the exception that the clamp abuts the left arm and left siderail.

Figure 2:
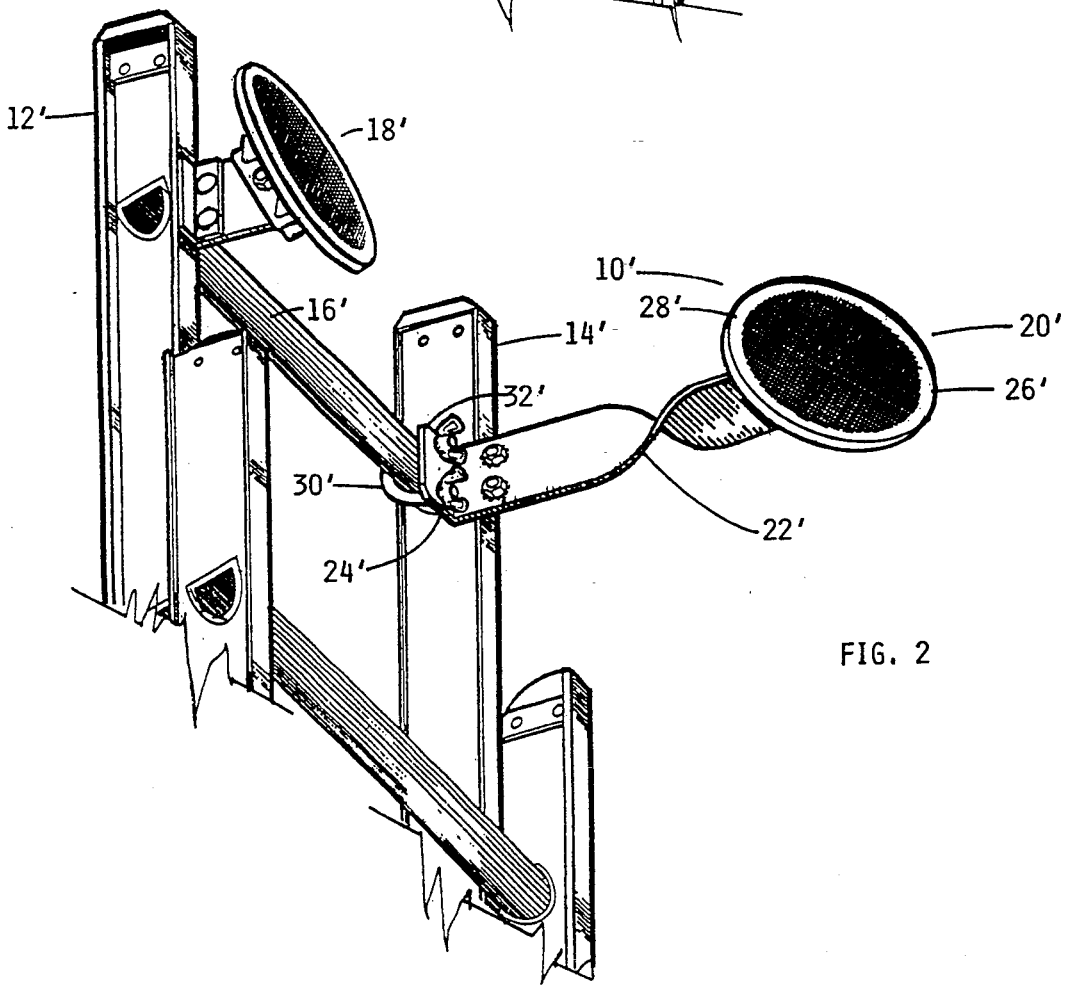
FIG. 2 is a diagrammatic view of a ladder with large contact area braces similar to FIG. 1, but illustrating another embodiment.

Referring to FIG. 2, another embodiment of an arm 22' illustrated wherein the arm 22' has a twist to rotate the opening in the distal and of the arm 22' about ninety degrees so that the resilient pad assembly 26' pivots horizontally instead of vertically. The ability to pivot horizontally allows the ladder 10 to straddle corners because the pad 26' can be pivoted to contact opposite faces of a corner. Inside corners, as well as outside corners, can be straddled.

While operation of the present invention is believed to be apparent from the foregoing description, a few words will be added for emphasis. The brace assembly 20 is installed by attaching the resilient pad assembly 26 to the arm 22 with the bolt 28 so that the pad assembly pivotally moves on the arm 22. After attaching the pad assembly 26, the arm 22 is moved toward the rung 16 so that the flange 24 abuts the rung 16. The U-bolt 30 is inserted and the nuts finger tightened. With the U-bolt nuts finger tight, the clamp 32 is positioned with one side of the L-shaped clamp 32 abutting the bottom surface of the siderail 12 and the other side of the clamp 32 abutting the arm 22. The openings are aligned, a bolt is inserted and a nut is tightened to secure the clamp 32 to the arm 22. Once the clamp 32 is securely tightened in position, the nuts on the U-bolt are finally tightened to secure the brace assembly 20 in position. When assembled in this manner, the clamp 32 exerts a force against the bottom face of the siderail 14 to prevent any motion of the arm 22 toward or away from the siderail 14. In use on a flat work surface, the forces exerted against the brace assembly 20 are outward forces from the center of the ladder 10 toward the siderail 14. Thus, the U-bolt 30 can be torqued enough to prevent inward movement of the arm 22. In use on a corner work surface the forces exerted against the brace arm 22' may be inward or outward forces which are resisted by the action of the resilient pad 26' on the work surface.

When the length of the arm 22 exceeds about six to eight inches, the construction of the brace assembly 20 may be of heavier gauge material to resist forces tending to move the arm 22 toward the center of the ladder. Alternatively, the bolts securing the clamp 32 to the arm 22 may be a single bolt extending from the arm 22 of the right brace assembly 20 to the arm of the left brace assembly 18 with nuts abutting each side of each arm to resist inward movement of the arms, and outward movement as well. This can be advantageous when it is desired to position the arms inward of the siderails instead of abutting the siderails. As another alternative, the bolt 28 may be a single bolt extending from the right pad assembly 26 all the way over to the left pad assembly to thereby resist movement of the pad assembly 26 and arm 22 inward, and outward as well. Such arrangements could be useful in less substantial aluminum ladders and fiberglass ladders, and others, where there is a limit on the amount the U-bolt 30 can be torqued.

It will be now appreciated that there has been presented a an attachment for a ladder to improve the lateral stability of the ladder. The ladder that contacts the work surface with a broad surface area that does not dent, scrape or mar the work surface. The present invention to provide a non-slip gripping portion for a ladder that grips the work surface without damaging the work surface. The non-slip gripping portion effectively increases the contact area of the ladder with the work surface which improves the lateral stability of the ladder, and allows the ladder to straddle corners.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

I claim:

1. A brace for a ladder having first and second siderails connected by a rung, comprising:

an extension arm having a flange formed on one end portion at a right angle to said arm and an opening in the distal end portion, said flange having first and second openings, said arm has a middle portion with a slot intermediate said end portions;

a U-bolt having legs inserted through said first and second openings of said flange and having said legs having threaded ends and being spaced to receive said ladder rung therebetween;

first and second nuts threadably mateable with said legs of said U-bolt to secure said flange to said U-bolt;

an L-shaped clamp having an opening, said clamp being positioned in abutting contact with said arm with said clamp opening and said arm slot aligned to receive a fastening bolt, and being positioned in abutting contact with one of said first and second siderails;

a resilient pad assembly; and means for pivotally connecting said resilient pad assembly about said opening in said distal end portion of said extension arm.

2. A brace, as set forth in claim 1, wherein said clamp acts in concert with said slot to accommodate different sizes of siderails.

3. A brace, as set forth in claim 1, wherein said pad assembly pivots horizontally.

4. A brace, as set forth in claim 1, wherein said pad assembly pivots vertically.

* * * * *